US008474520B2

(12) United States Patent
Martinez et al.

(10) Patent No.: US 8,474,520 B2
(45) Date of Patent: Jul. 2, 2013

(54) WELLBORE DRILLED AND EQUIPPED FOR IN-WELL RIGLESS INTERVENTION ESP

(75) Inventors: Ignacio Martinez, Rio de Janeiro (BR); Raul M. Krasuk, Rio de Janeiro (BR); Juan M. Garoby, Rio de Janeiro (BR)

(73) Assignee: Baker Hughes Incorporated, Houston, TX (US)

( * ) Notice: Subject to any disclaimer, the term of this patent is extended or adjusted under 35 U.S.C. 154(b) by 352 days.

(21) Appl. No.: 12/835,578

(22) Filed: Jul. 13, 2010

(65) Prior Publication Data

US 2011/0011596 A1 Jan. 20, 2011

Related U.S. Application Data

(60) Provisional application No. 61/225,292, filed on Jul. 14, 2009.

(51) Int. Cl.
*E21B 43/00* (2006.01)

(52) U.S. Cl.
USPC ..... 166/65.1; 166/105; 166/106; 166/68

(58) Field of Classification Search
USPC ..... 166/65.1, 68, 69, 105, 106, 107, 166/109
See application file for complete search history.

(56) References Cited

U.S. PATENT DOCUMENTS

| | | | | |
|---|---|---|---|---|
| 3,835,929 | A * | 9/1974 | Suman, Jr. | 166/384 |
| 6,966,384 | B2 * | 11/2005 | Griffiths | 166/380 |
| 2002/0050361 | A1 * | 5/2002 | Shaw et al. | 166/380 |
| 2007/0289747 | A1 * | 12/2007 | Shaw et al. | 166/368 |
| 2009/0090512 | A1 * | 4/2009 | Zupanick | 166/380 |

* cited by examiner

*Primary Examiner* — Giovanna Wright
*Assistant Examiner* — Richard Alker
(74) *Attorney, Agent, or Firm* — Bracewell & Giuliani LLP

(57) ABSTRACT

A string for drilling a well for installation and retrieval of ESP equipment without a rig. A well is drilled past the end of casing which has been cemented in place and extends to a wellhead at the surface. A receptacle is attached between production casing joints and run into the well 10. The receptacle is a tubular member with an inclined pocket formed on a side. At least one passage or port in the pocket intersects with a passage in receptacle with one or more lengths of tubing attached to the pocket. A wet connector within the production casing is landed in the receptacle and self aligns to the tubing. Electrical wires run within the tubing mate and lock with the wet connector. This allows an ESP to be run into the well via winch such that it stabs into the wet connector to receive power.

20 Claims, 9 Drawing Sheets

WELLBORE DRILLED AND EQUIPPED FOR IN-WELL RIGLESS INTERVENTION ESP

CROSS-REFERENCE TO RELATED APPLICATION

This application claims priority to provisional application 61/225,292 filed Jul. 14, 2009.

FIELD OF THE INVENTION

This invention relates in general to installation and retrieval of electrical submersible pumps (ESPs), and in particular to a string for drilling a well for installation and retrieval of ESP equipment without a rig.

BACKGROUND OF THE INVENTION

ESP's are used in wells to pump formation fluids, such as oil, up to the surface via production tubing. Generally a rig is required to install and retrieve an ESP and its components, such as a wet connector or electrical cables, down and out of the well. Once in place the ESP system controls the production of fluid to the surface.

It is desirable to install and remove the ESP and its components in a cost-effective, simplified, and environmentally friendly manner. However, the rig is a critical and expensive resource in subsea or remote applications. In addition, providing power and connection for the ESP's motor can be difficult.

A technique is thus needed to install and retrieve and ESP and its components that is feasible and cost-effective.

SUMMARY OF THE INVENTION

In an embodiment of the present invention, a wellbore drilled and equipped for in-well rigless intervention is illustrated in which an ESP string can be installed or retrieved without the use of a rig. The wellbore is drilled past the end of casing cemented in place and a receptacle is attached between production casing joints and run into the well. The casing extends to a wellhead at the surface. The receptacle is a cylindrical tubular member with an inner diameter that may be the same as that of the casing. An inclined pocket may be formed on a side of the receptacle.

A passage or port in the pocket intersects with the passage in receptacle, which is located below the lower end of casing in an embodiment of the present invention. Thus, the receptacle communicates the tubing to the interior of the production casing. One or more lengths of auxiliary tubing is attached to the pocket and run into the well at the same time the casing is being run, with the auxiliary tubing strapped or clamped to the exterior of the production casing. Auxiliary tubing is much smaller in diameter than casing and can be either continuous coiled tubing or sections of tubing screwed together. The receptacle, casing, and auxiliary tubing are cemented in place within the well in a conventional way.

With the receptacle and auxiliary tubing in place within the well, a wet connector is run inside the production casing and landed in the receptacle, self aligning with the coiled tubing. Electrical cables can then be run down the inside of the coiled tubing and connected to the wet connector. In this embodiment, three electrical cables for 3-phase power are individually run down three individual coiled tubes. In this embodiment, the wet connector has three conductors located on its inside surface located above the passages in the receptacle to allow the conductors to electrically communicate with the ends of the electrical cables. The conductors may connect to the stab-in section of the wet connector via electrical connections. The auxiliary tubing connected to the receptacle and housing the electrical cables, makes it possible for the electrical cables and wet connector to be installed or retrieved without a rig. This is because the electrical cables are not clamped to the side of tubing string as in conventional methods.

Once the wet mate connector and electrical cables are in place, the wellbore is then ready to receive an ESP assembly that can be run into the well via a wireline winch, for example. The ESP assembly may include a motor, a seal section, and a pump in this embodiment. The motor in this embodiment is located at the bottom of the ESP assembly and has a conductor stab extending from below. The ESP is lowered into the well until the stab-in section of the wet connector engages the conductor stab below motor. The conductor stab can have three conductor pins that stab into receptacles located in the stab-in section through the use of an orientation device on the conductor stab that orients the pins with the receptacles. The receptacles allow electrical communication with the power cables to thus provide electrical power to the ESP. The ESP is electrically supplied by the electrical power cables connecting to the wet connector via the coiled tubing. Once the ESP is stabbed into place, a packer is set to seal the discharge of the ESP from its intake and the receptacle. If the ESP must be retrieved, the ESP assembly may simply be retrieved by wireline winch as well.

The invention is simple and allows for cost-effective ESP installation and retrieval via a wireline or coiled tubing. This invention advantageously allows the ESP assembly, wet connector, or electrical cables, to be installed or retrieved within a wellbore drilled to accommodate rigless in-well intervention. This invention could help operators decrease the overall cost of installation and retrieval of ESP systems.

DETAILED DESCRIPTION OF THE INVENTION

Figure 1:
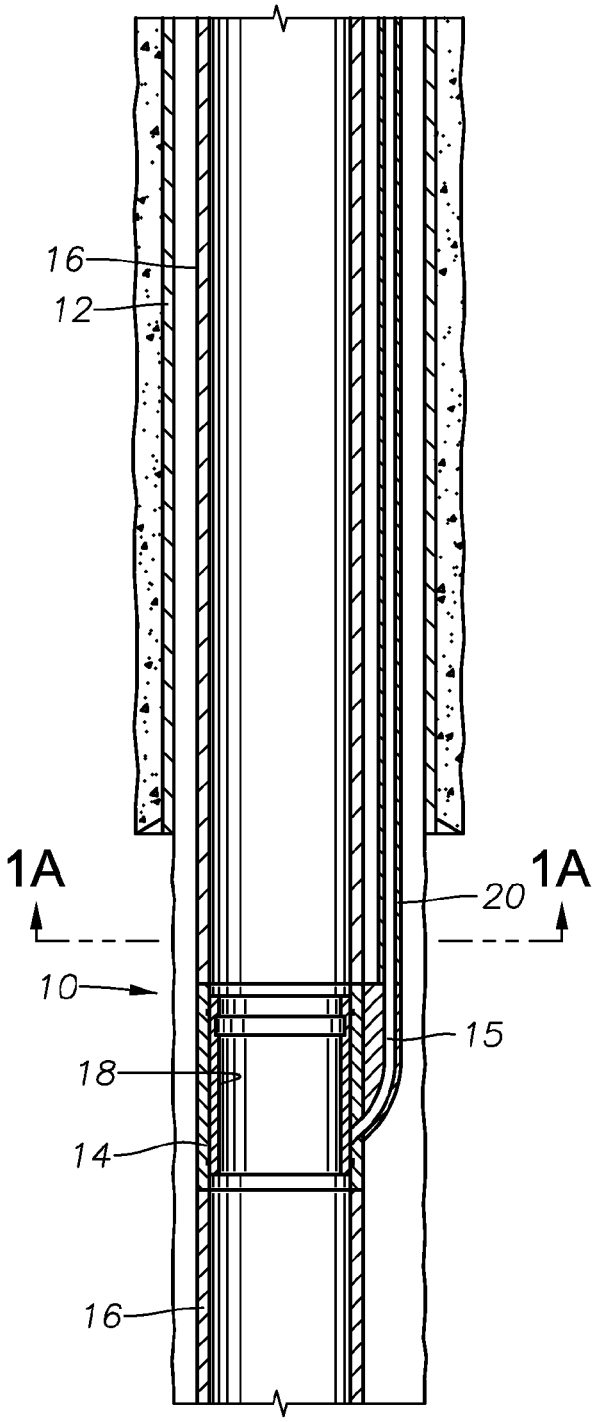
FIG. 1 shows a well production assembly during installation of the production casing, in accordance with the invention.
Figure 3:
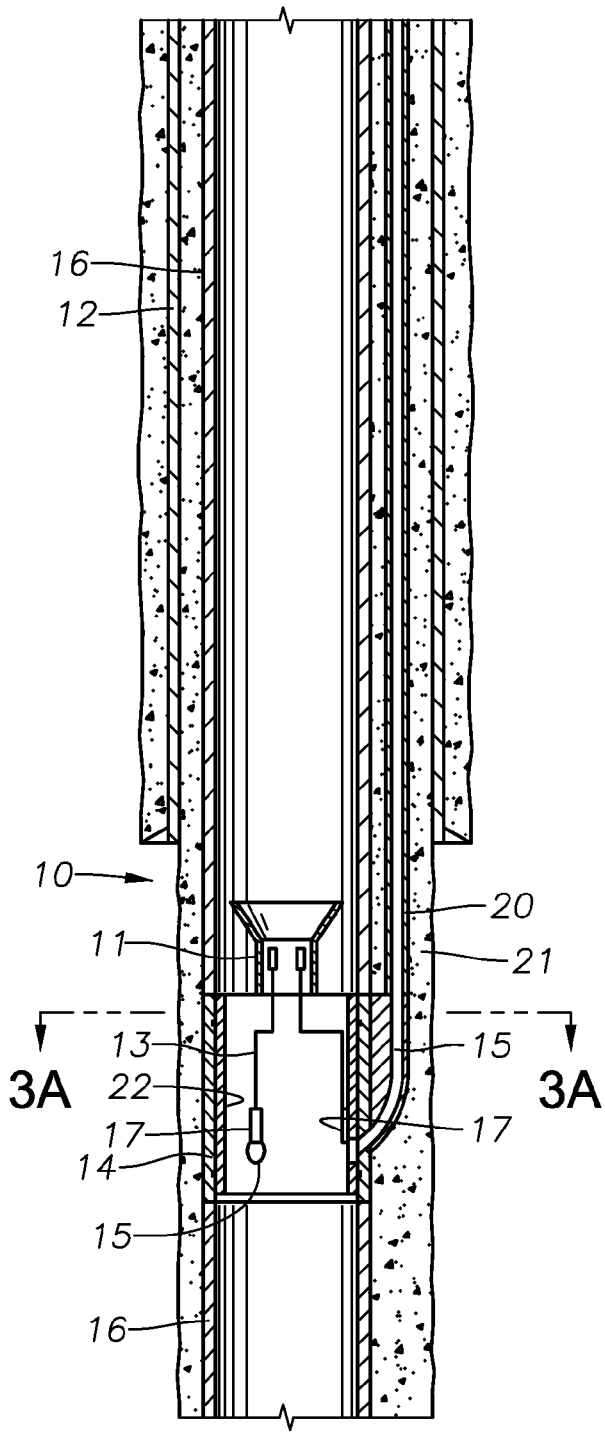
FIG. 3 shows the assembly of FIG. 2 with a wet connector run inside the production casing and landed in the receptacle, in accordance with the invention.
Figure 3A:
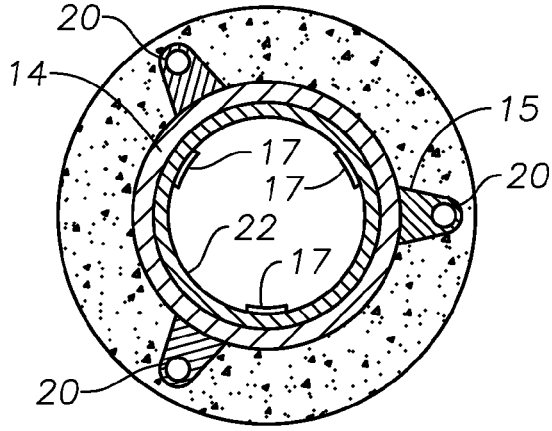
FIG. 3A is a sectional view illustrating portions of the production assembly of FIG. 3 taken along the line 3A-3A of FIG. 3.

In FIG. 1, a well 10 is drilled past the end of casing 12, which has been cemented in place. A receptacle 14 is attached between production casing 16 joints and run into the well 10. Casing 16 extends to a wellhead at the surface. The receptacle 14 is a cylindrical tubular member with an inner diameter that may be the same as that of the casing 12 with a pocket 15 formed on a side and inclined. However, it is not required that the inner diameter of the receptacle 14 be the same as the inner diameter of the casing 12. At least one passage or port in pocket 15 intersects with passage in receptacle 14. Receptacle 14 is located below the lower end of casing 12. The inner diameter of the receptacle 14 can vary depending on the size of the casing 12. Preferably one or more lengths of auxiliary tubing 20 is attached to pocket 15 when the receptacle 14 is at the surface. In this embodiment, the receptacle 14, auxiliary tubing 20, and casing 16 run into the well 10 at the same time as part of the same string. The auxiliary tubing 20 can be strapped or clamped to the exterior of the production casing 16. Auxiliary tubing 20 could either be continuous coiled tubing or it could be sections of tubing screwed together. Auxiliary tubing 20 is much smaller in diameter than casing 16 and may be attached to the pocket 15 as a compression fit, or alternatively may be threaded or welded to the pocket 15. Alternatively, as shown in FIG. 3A, a plurality of pockets 15 can be formed on the receptacle 14, with each receiving auxiliary tubing 20.

Figure 1A:
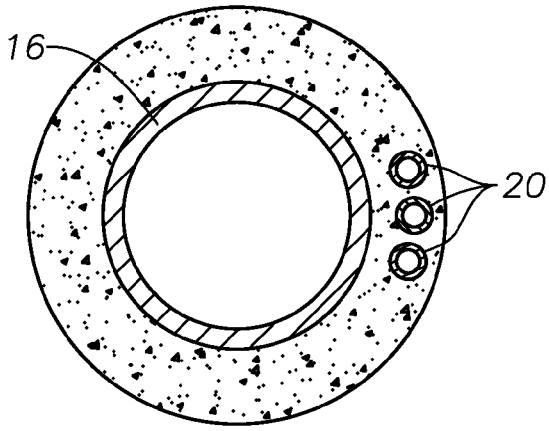
FIG. 1A is a sectional view of the production assembly of FIG. 1 taken along the line 1A-1A of FIG. 1.

The receptacle 14 communicates the coiled tubing 20 to the interior of the production casing 16. An isolation sleeve 18 can be placed on the top portion of the receptacle 14 during cementing to allow tools to operate below the receptacle 14 or to allow production of the well 10 without communication with the coiled tubing 20. The use of an isolation sleeve 18 is optional. Alternatively, a retrievable plug (not shown) can be located at the end of the coiled tubing 20 connecting to the receptacle 14. As seen in FIG. 1A, more than one auxiliary tubing strings 20 may be mounted to receptacle 14.

Figure 2:
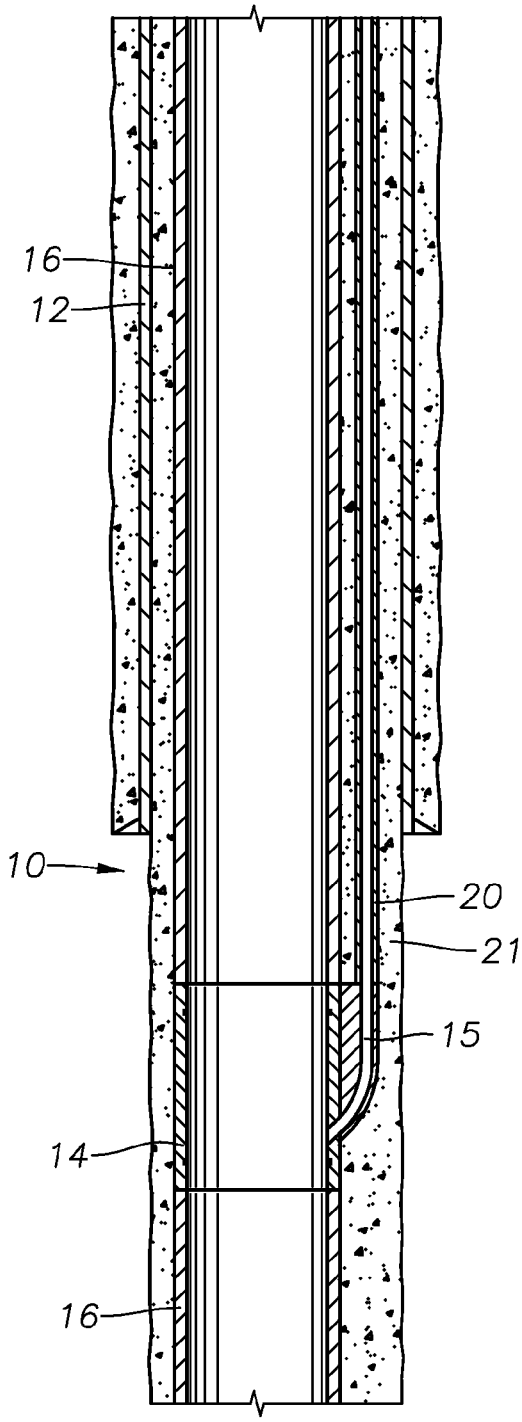
FIG. 2 shows the assembly of FIG. 1 during cementing of the production tubing and coiled tubing, in accordance with the invention.

The assembly in FIG. 1 is then cemented in place in a conventional manner. Cement 21 (FIG. 2) flows around receptacle 14 and a lower portion of auxiliary tubing 14. Once the production casing 16 and the coiled tubing 20 is cemented in place as shown in FIG. 2, isolation sleeve 18 is removed. Then a wet connector 22 (FIG. 3) is run inside the production casing 16 via wireline or tubing and landed in the receptacle 14, self aligning with the coiled tubing 20. If the well is going to produce naturally, or by other means, the isolation sleeve 18 can remain installed. The wet connector 22 may be a standard wet connector. Alternatively, a wet mate connector such as that disclosed in pending application Ser. No. 12/060,525, which is herein incorporated by reference in its entirety, may be used.

Figure 4:
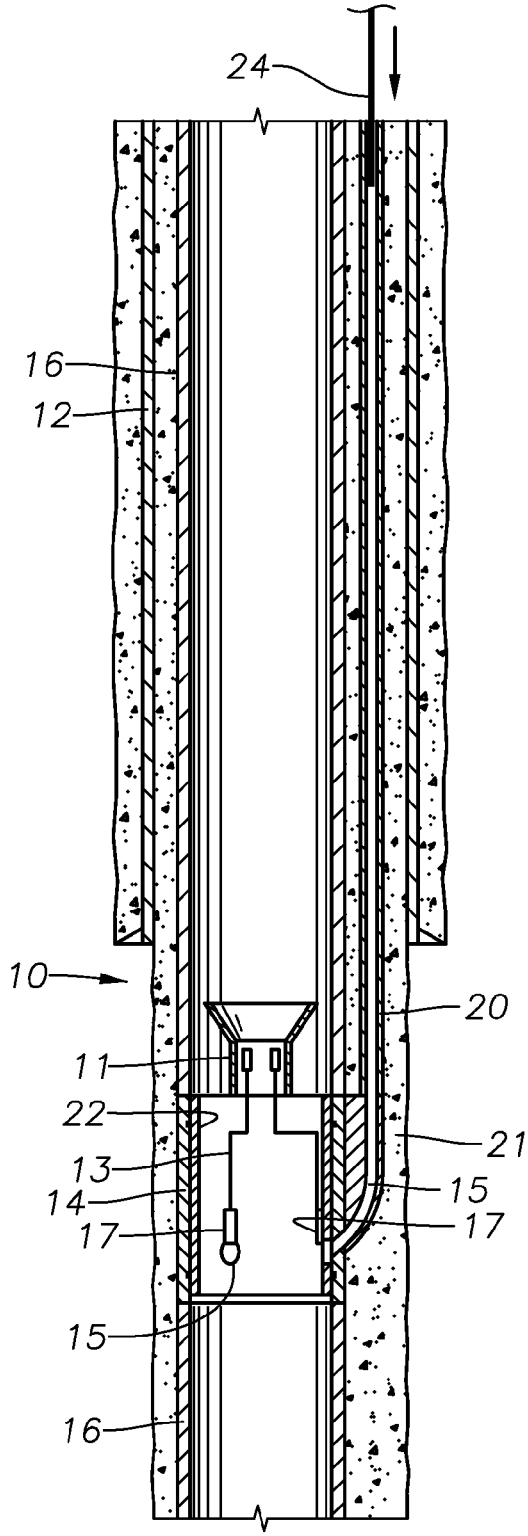
FIG. 4 shows the assembly of FIG. 3 with a wire line run into the coiled tubing, in accordance with the invention.

Electrical cables 24 can then be run down the inside of the coiled tubing 20 as shown in FIG. 4 until the cables 24 mate and lock with the wet connector 22. A retaining ring or quick disconnect type connectors, for example, can be located at the passages of the receptacle 14 to lock the cables 24 in place. In this embodiment, three electrical cables 24, one for each phase, are individually run down three individual coiled tubes 20. This configuration of electrical cables 24 (FIG. 4) allows for the use of smaller diameter coiled tubing 20. The wet connector 22, in this example, also serves to isolate the coiled tubing 20 from the production casing 16. In this embodiment, the wet connector 22 has three conductors 17 located on its inside surface, as shown in FIG. 3A, that are located above the passages in the receptacle 14 to allow the conductors to electrically communicate with the end of the electrical cables 24. The conductors 17 may connect to the stab-in section 11 of the wet connector 22 via electrical connections 13. Alternatively, the conductors 17 could extend up to the stab-in section without the use of electrical connections.

Figure 17:
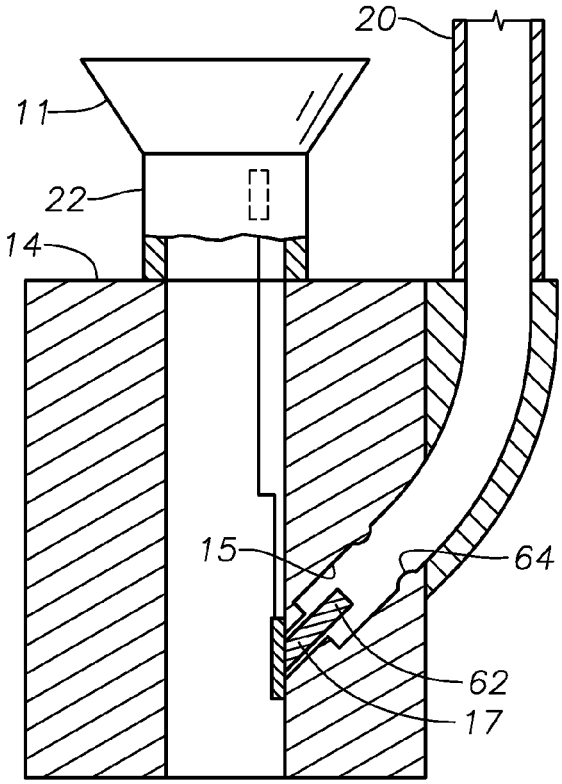
FIG. 17 shows an example of how the receptacle pocket receives an end cable assembly, in accordance with the invention.
Figure 18:
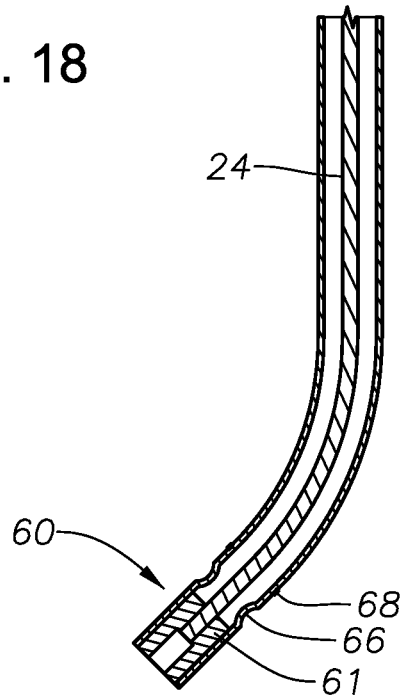
FIG. 18 shows an example of an end cable assembly for a cable for latching onto a conductor in the receptacle pocket, in accordance with the invention.
Figure 19:
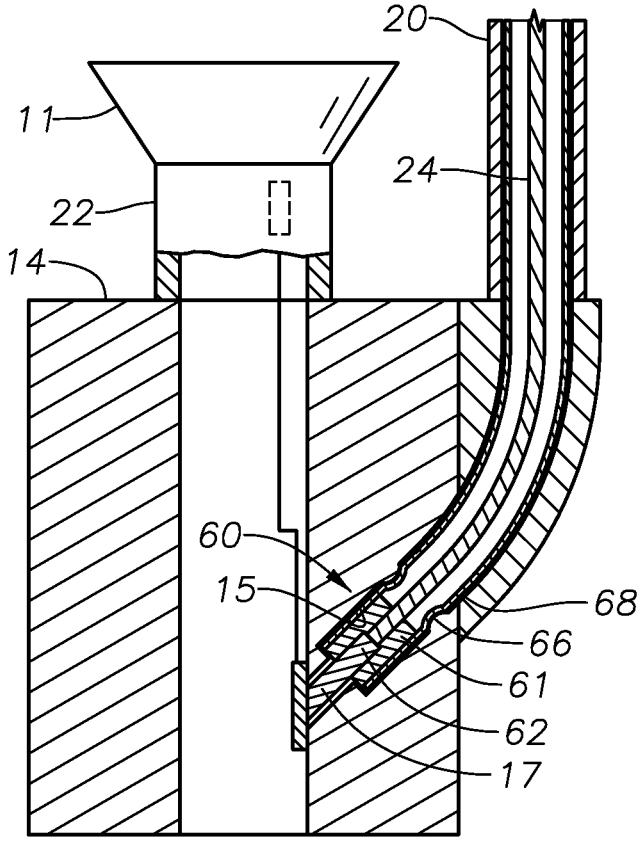
FIG. 19 shows an example of the end cable assembly of FIG. 18 latched onto an electrical connection in the pocket shown in FIG. 17, in accordance with the invention.

FIGS. 17-19 show an example of a latching system for mating and locking a cable 24 within the receptacle 14 to electrically communicate with the wet connector 22 via a conductor 17. An end assembly 60 on the electrical cable 24 has a female electrical connection 61 that mates with a male electrical connection 62 located inside the receptacle pocket 15 and in communication with the conductor 17, as shown in FIG. 19. The electrical cable 24 and conductor 17 may be insulated. A diameter reduction 64 within the pocket 15 corresponds to circumferential recess 66 on the exterior of the electrical cable 24. The cable 24 is initially spooled into the auxiliary tubing 20 but eventually the weight of the cables 24 is sufficient to run it into the auxiliary tubing 20 and cause the circumferential recess 66 on the cable 24 to latch onto the diameter reduction 64 inside the pocket, locking the cable 24 in place while establishing electrical connection between the cable 24 and the conductor 17 within the receptacle 14. Together, the recess 66 and diameter reduction 64 form a latching system for the cable 24. A seal or O-ring 68 is located at a point on the electrical cable above the recess 66 to mechanically and electrically seal the connection between the female and male electrical connections 61, 62. To retrieve the cable 24, sufficient tension to overcome the latching system and weight of the cable 24 is placed on the cables 24 that will allow the recess 66 to unlatch from the diameter reduction 64, allowing the mating end 61 to disconnect from the male connection 62.

Figure 5:
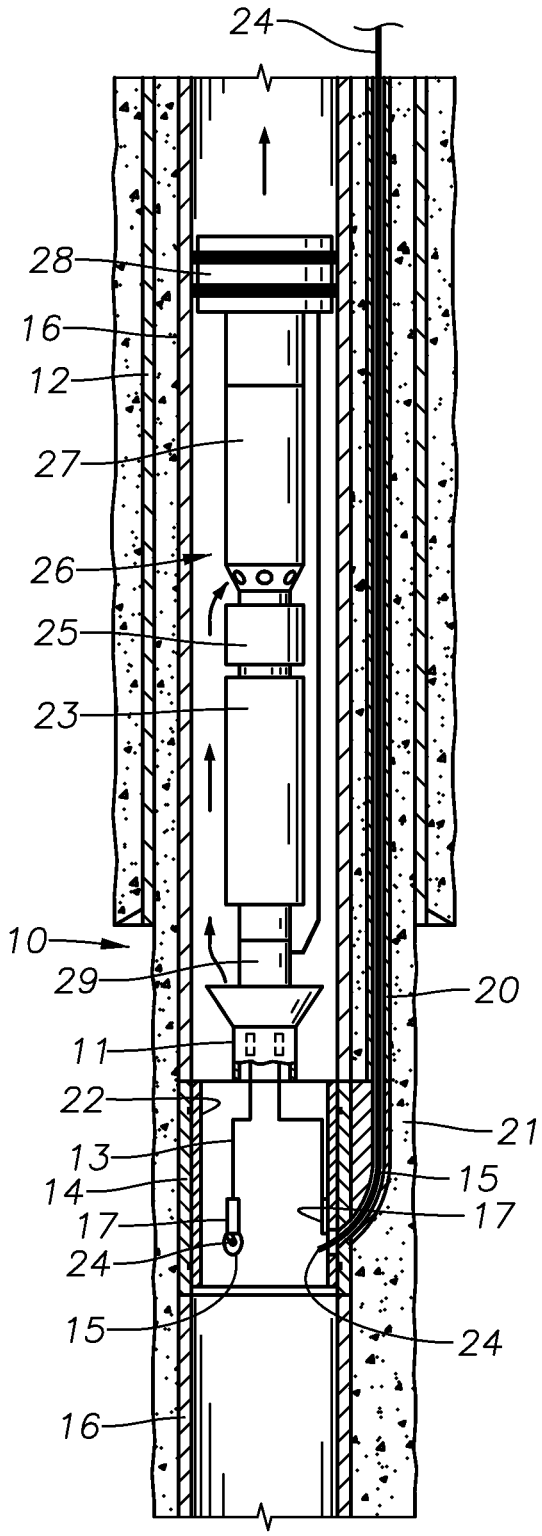
FIG. 5 shows the assembly of FIG. 4 with an ESP run inside the production tubing and connected to the wet connector, in accordance with the invention.
Figure 5A:
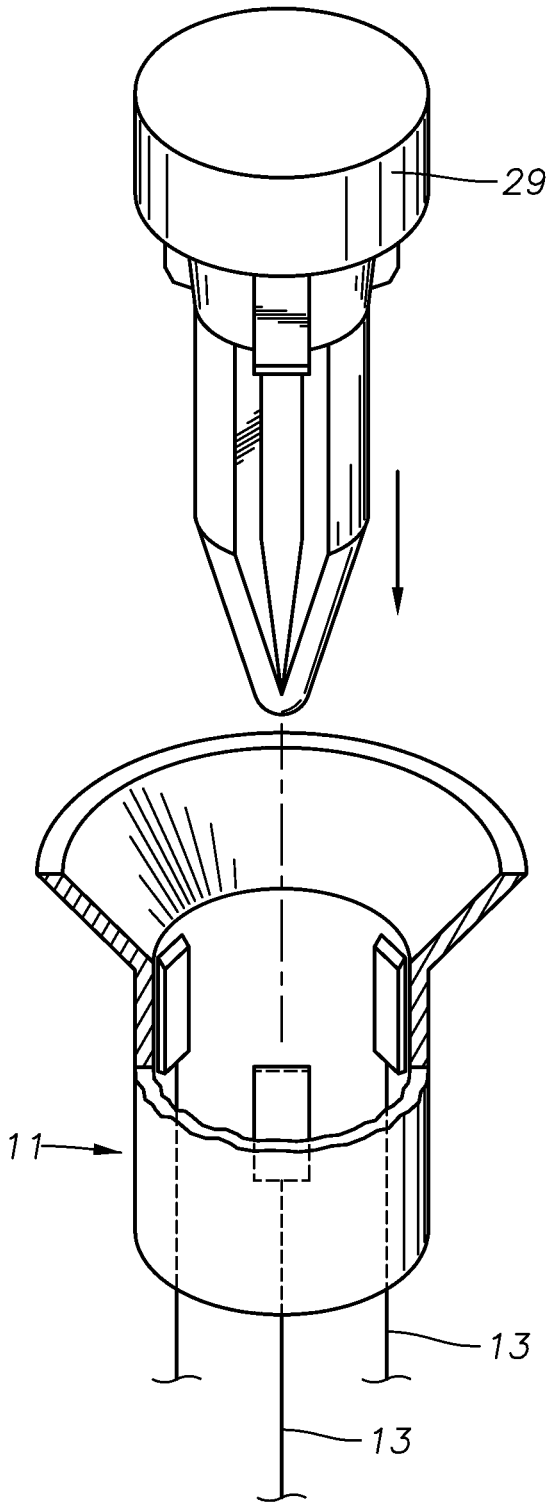
FIG. 5A shows an example of how the conductor stab connects to the stab-in portion of the wet connector, in accordance with the invention.

A wireline winch (not shown) can then be used to run an ESP assembly 26 into the production casing 16 using a wireline (not shown) that would normally not have an electrical conductor. ESP 26 comprises a motor 23, a seal section 25, and a pump 27. The seal section 27 equalizes lubricant pressure in the motor 23 with hydrostatic pressure on the exterior. A conductor stab 29 extends below motor 23. Pump 27 could be a centrifugal pump or progressing cavity pump. The ESP 26 is lowered into the well 10 until the stab-in section 11 of the wet connector 22 engages the conductor stab 29 below motor 23 at the bottom of the ESP 26 as shown in FIG. 5. The conductor stab 29 can have, for example, three conductor pins as shown in FIG. 5A that stab into receptacles located in the stab-in section 11. In this embodiment, an orientation device comprising raised surfaces on the conductor stab to orient the pins with the receptacles. The receptacles can be connected to the conductors 17 with electrical connections 13 to allow electrical communication with the power cables 24. The ESP 26 is thereby electrically supplied by the electrical power cables 24 connecting to the wet connector 22 via the coiled tubing 20. The wet connector 22 has three electrical conductor rings that engage contacts that are free to move some in and out. Packer 28 is set to seal the discharge of the ESP 26 from its intake and the receptacle 14 and wet connector 22 have bores that allow production fluid to flow through them. ESP 26 discharges well fluid into production casing 16, which flows to the wellhead at the surface.

Figure 6:
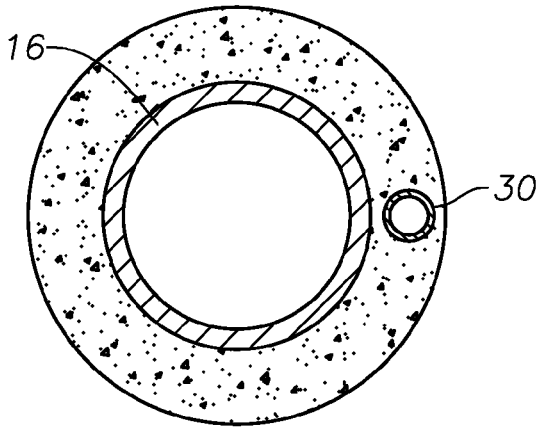
FIG. 6 is a sectional view similar to FIG. 1A, but showing an additional embodiment using a single coiled tubing string, in accordance with the invention.

In another embodiment, as shown in FIG. 6, a single length of coiled tubing 30 can be run alongside the production casing 16. The coiled tubing or tubing 30 is sufficiently large in diameter to carry a 3-phase cable within. The wet connector 22 would have all three contacts aligned with the single port in the receptacle.

Figure 7:
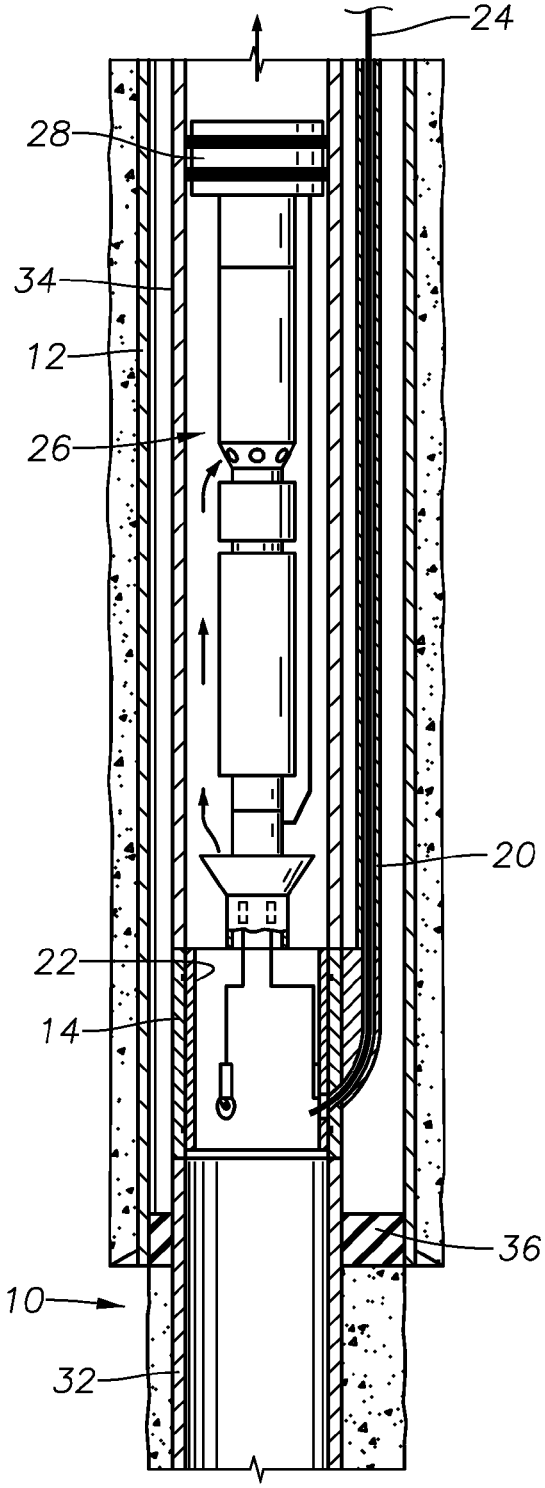
FIG. 7 shows an additional embodiment of a production assembly, with liner string run and cemented to the depth where the ESP is located, in accordance with the invention.

In a further embodiment, as shown in FIG. 7, casing 12 is installed and cemented in the well 10. The casing 12 is sufficiently large to accommodate production casing 34 and coiled tubing 20 to carry the electrical cables 24. A lower section having a smaller diameter than the casing 12 is drilled below the receptacle 14. The lower section is not large enough in diameter for receptacle 14. A string of casing 32 is connected to a lower portion of the receptacle 14 and lowered into the lower section. Receptacle 14 in this embodiment is above the lower end of the casing 12. An upper string of casing 34 that is the same diameter as casing 32 extends to a wellhead at the surface. Casing 32 is then cemented in place. A packer 36 below receptacle 14 is provided that prevents the receptacle 14, production casing 34, and coiled tubing 20, from being cemented in place. Packer 36 seals annulus between casing 32 and casing 12. Once the liner 32 is cemented, the wet connector 22 and ESP 26 can be lowered into the production casing 34 in the same manner as in the first embodiment.

Figure 8:
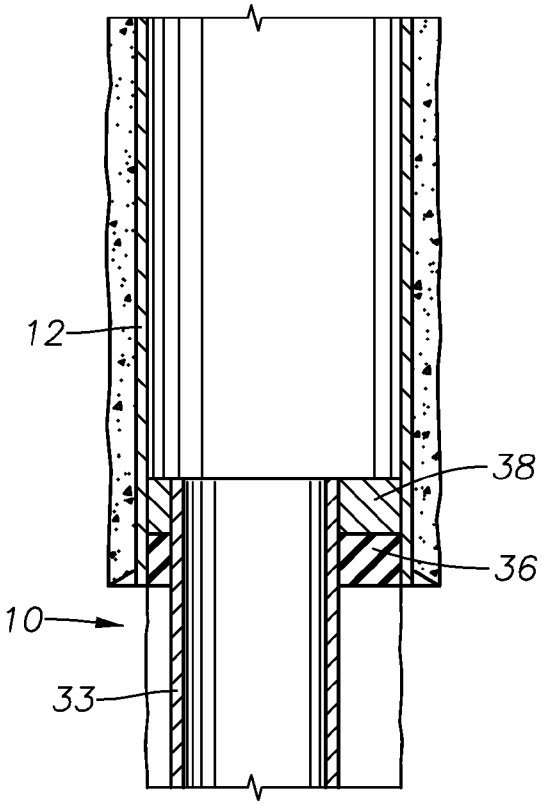
FIG. 8 shows an additional embodiment of a production assembly illustrating a liner string prior to installing a receptacle and coiled tubing, in accordance with the invention.
Figure 9:
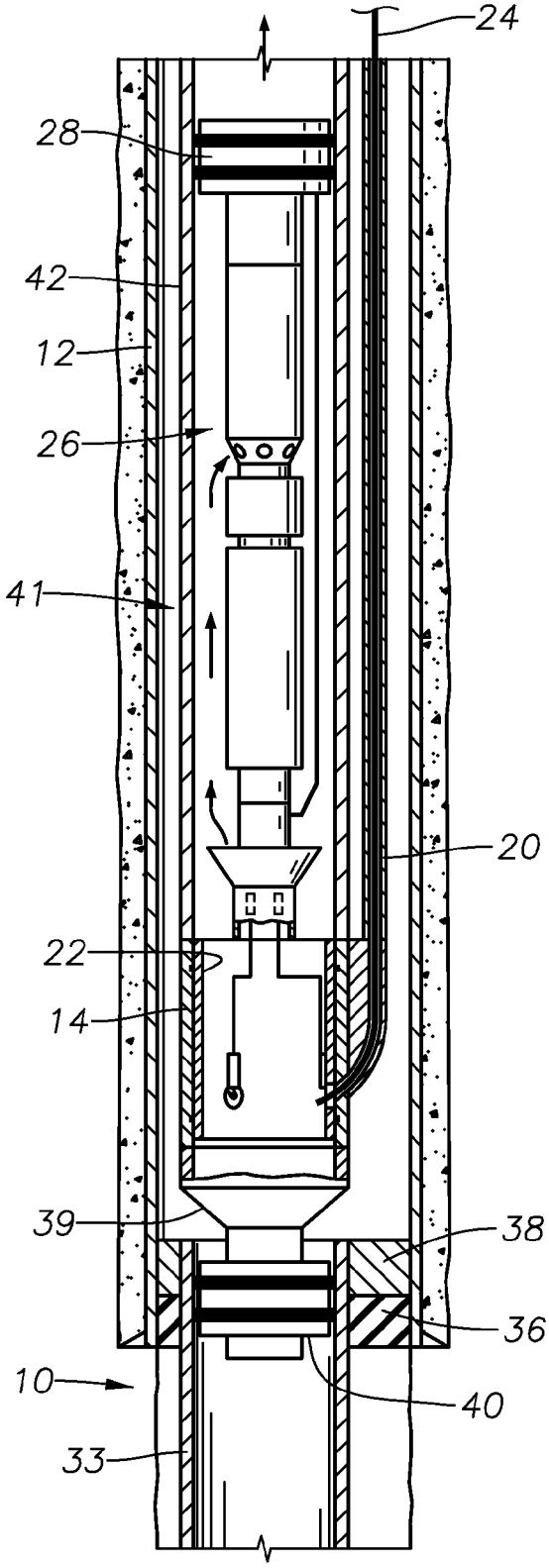
FIG. 9 shows the completed installation of the assembly of FIG. 8.

In an additional embodiment, casing 12 is installed in the well 10. A lower section having a smaller diameter than the casing 12 is drilled and a liner 33 is hung from a liner hanger 38 and packer 36, as shown in FIG. 8. Liner 33 comprises joints of casing but the upper end extends only a short distance above the lower end of casing 12. The liner hanger 38 and liner packer 36 are installed just above the lower end of the casing 12 and cemented in place. Packer 40 is then set in upper end of liner. An assembly 41 will then be lowered into the well as part of a production tubing string 42, as shown in FIG. 9. Tubing string 42 extends to wellhead at the surface. The assembly comprises a receptacle 14 and wet connector 22 that are connected to the lower end of the production tubing 42. The assembly 41 further comprises, a tubular seal stab 39 that stabs into lower packer 40 and joins the receptacle 14 to lower packer 40. Lower packer 40 could be run and set before installing receptacle 14 and tubing 42. After assembly 41 is installed, ESP 26, along with an upper packer 28, is lowered through the production tubing 42 and landed in receptacle 14. Coiled tubing 20 housing electrical cables 24 also comprises a part of the assembly 41 and connects to the receptacle 14 to allow the electrical cables 24 to mate and lock with the wet connector. The upper packer 28 is set against the inside of the production tubing string 42 to seal the discharge of the ESP 26. Upper packer 28 has a line leading to one of the ports in the receptacle 14. The line supplies energy to set the packer 28 and can be hydraulic or electric. When the assembly 41 is run down into the well 10 with the production tubing string 42, the lower packer 38 will have been previously set in the interior of the liner 32 to ready the well 10 for production.

Figure 10:
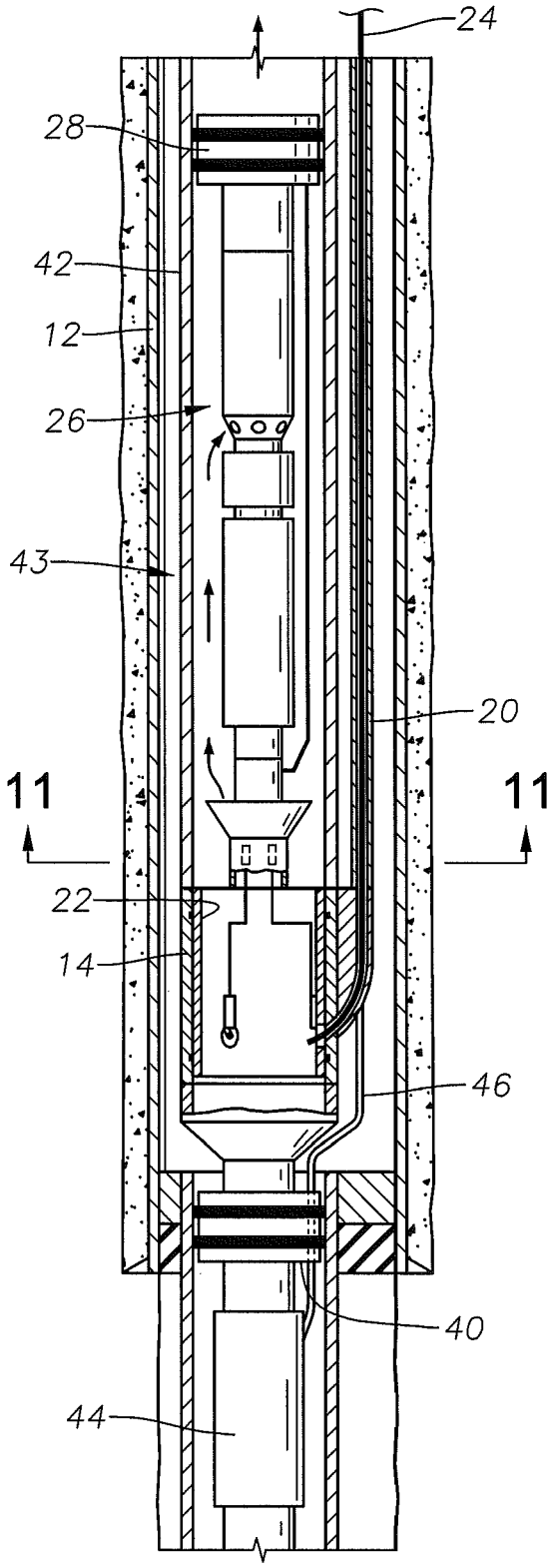
FIG. 10 shows an additional embodiment of a production assembly that uses a downhole safety valve, or similar valve, with the ESP system and also show the use of an additional coiled tube for a hydraulic line, in accordance with the invention.
Figure 11:
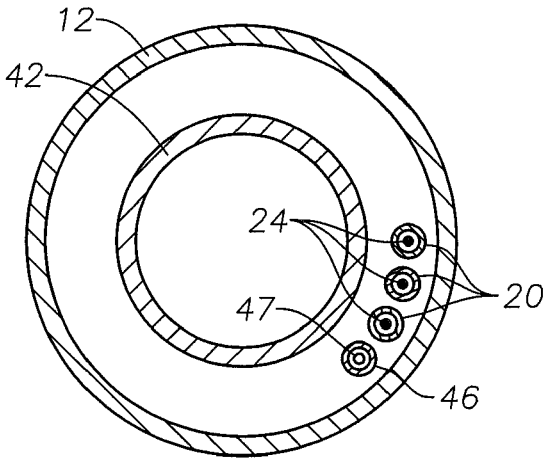
FIG. 11 is a sectional view illustrating portions of the production assembly of FIG. 10.
Figure 12:
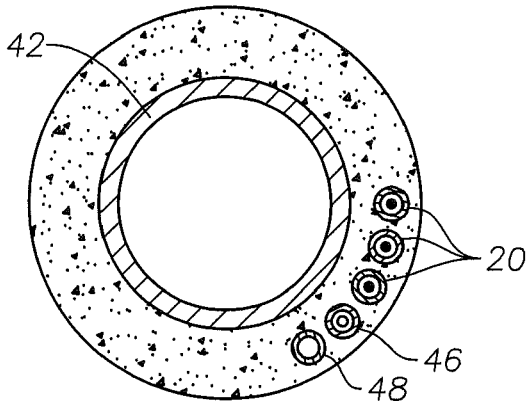
FIGS. 12 and 13 show sectional views of additional embodiments with alternative coiled tubing configurations in accordance with the invention.
Figure 13:
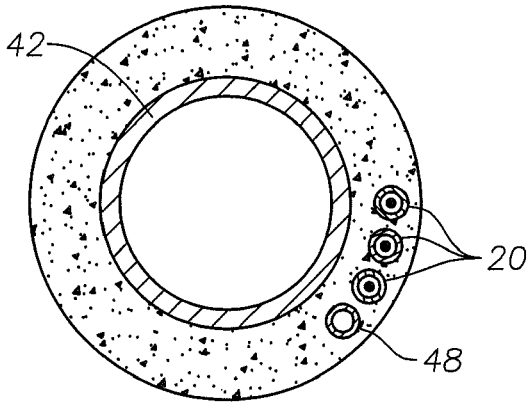

In another embodiment, a downhole safety valve ("DHSV") 44 or similar valve is added to an assembly 43 that is similar to assembly 41 in the previous embodiment, as shown in FIG. 10. A DHSV is a valve that is open only if hydraulic fluid pressure is being supplied. The assembly 43 comprises an upper packer 28, the ESP 26, coiled tubing 20, a receptacle 14, and a wet connector 22. The assembly 43 further comprises a lower packer 40 off of which the DHSV 44 will be hung before the production tubing string 42 is run into the well 10. The DHSV 44 can be used to control production from the well 10. To control the DHSV 44, an additional control line coiled tube 46 is provided through which a control line 47, normally hydraulic, can be run down to the receptacle 14, as shown in FIG. 11. Dotted lines in FIG. 10 illustrate coiled tube 46 extending downward through packer 40 to DHSV 44. The control line 47 will stab into the wet connector 22 to communicate with the DHSV 44. Alternatively, hydraulic fluid could be pumped directly into the tube 46 to control the DHSV 44 instead of through a separate control line. In this embodiment, the wet connector 22 is the interface for both the power cables 24 serving the ESP 26 and the control line 47 that controls the DHSV 44. Alternatively, an additional length of coiled tubing 48 can extend from receptacle 14 along with the electrical coiled tubing 20 and the control line coiled tubing 46. The additional coiled tubing 48 can be used to circulate brine around the ESP 26 to clean it or to clean the well 10 by circulating brine throughout the well 10. If no DHSV 44 is required, the circulating tube 48 can be located alongside the electrical coiled tubing 20 and the control line tubing can be omitted, as shown in FIG. 13.

Figure 14:
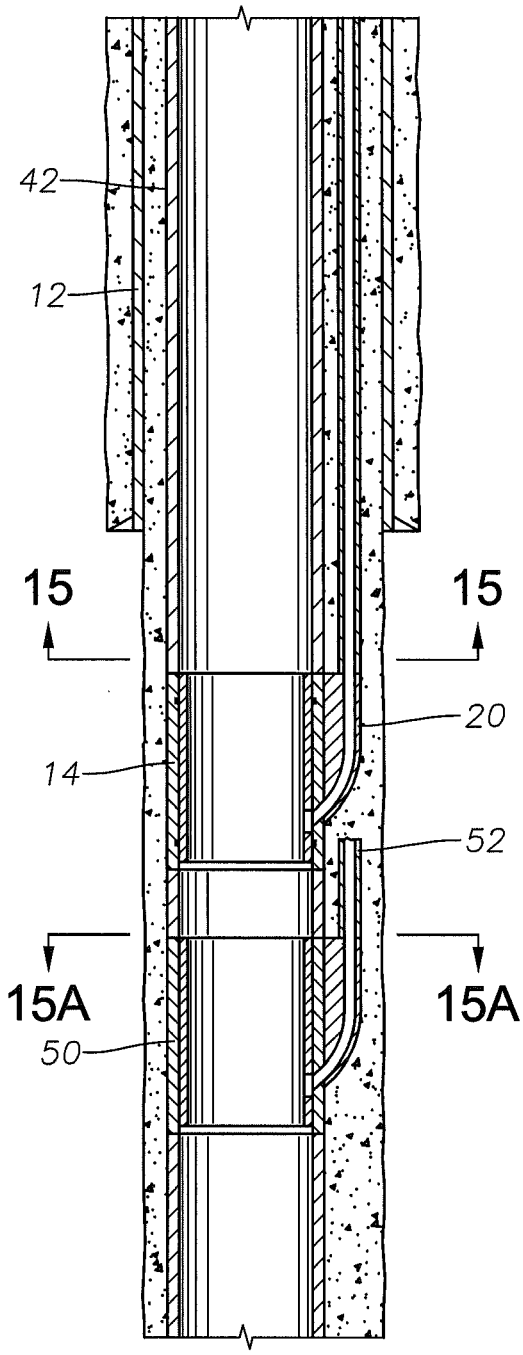
FIG. 14 shows an additional embodiment of a production assembly with two receptacles and a coiled tubing string for circulating the well, in accordance with the invention.
Figure 15:
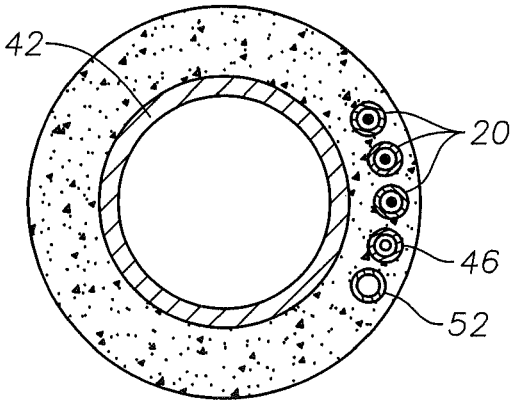
FIG. 15 is a sectional view showing the tubing string for circulating the well bypassing the first receptacle to connect to the bottom receptacle of FIG. 14.
Figure 15A:
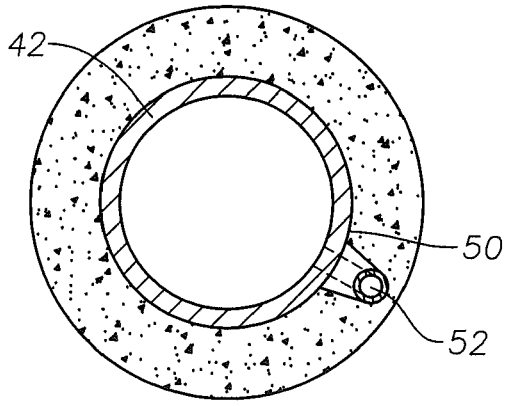
FIG. 15A is a sectional view showing the tubing string for circulating the well connecting to the bottom receptacle of FIG. 14.

In another embodiment, an additional receptacle 50, located below the receptacle 14 for the wet connector 22, can be used to provide a connection for a circulating tube 52, as shown in FIG. 14. The circulating tube 52 extends down past receptacle 14 and communicates with the interior of the production casing 16 via the lower receptacle 50 to allow for circulation of the well 10 with fluid. Alternatively, the circulating tube 52 can communicate with production tubing 42 instead of casing 16. The circulating tube 52 runs alongside the electrical coiled tubing 20 and the control line tubing 46, as shown in FIG. 15, and continues below the upper receptacle 14 to connect with the lower receptacle 50, as shown in FIG. 15A. Alternatively, the control line tubing 46 can be omitted if no DHSV 44 is used. Receptacles 14 and 50 are run in together along with tubing 42. They could be installed in accordance with any of the embodiments described.

Figure 16:
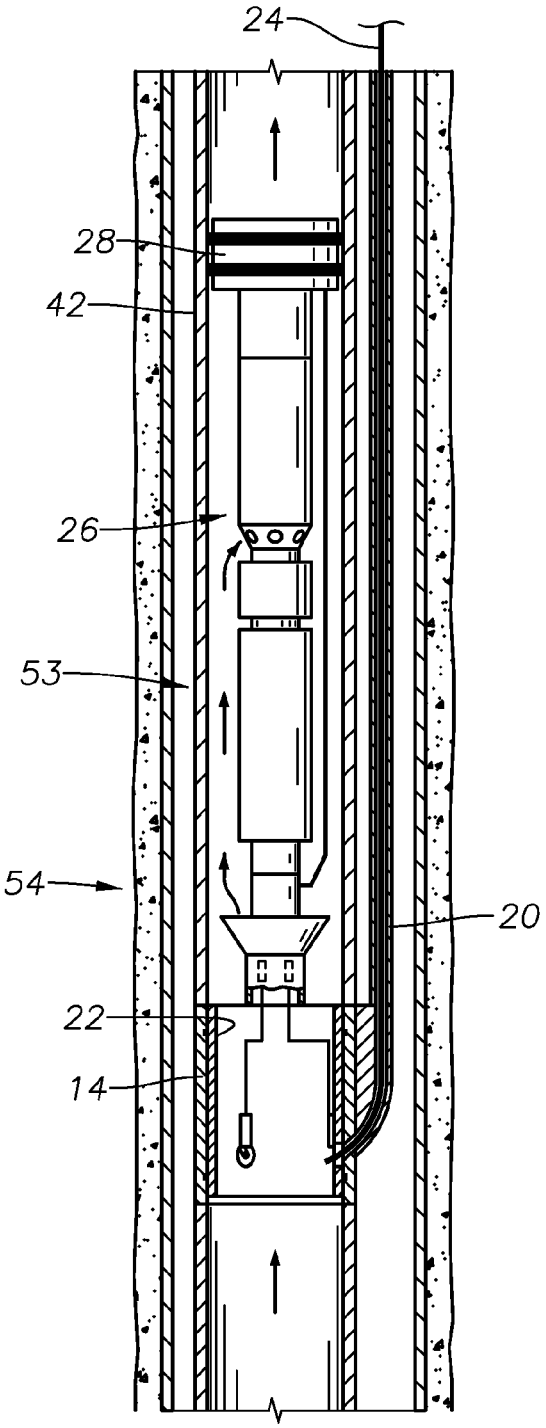
FIG. 16 shows an additional embodiment of a production assembly with the receptacle and coiled tubing attached to the production tubing, in accordance with the invention.

In a further embodiment, an assembly 53 can be run into a standard well 54, as shown in FIG. 16. The assembly 53 comprises an upper packer 28, the ESP 26, coiled tubing 20 housing the electrical cables 24, a receptacle 14, and a wet connector 22. In this embodiment, the receptacle 14 is connected to the production string 42 and the coiled tubing 20 housing the electrical cables 24 is attached to the exterior of the production tubing 42. The receptacle 14 can be run down to the desired depth in the standard well 54 on tubing 42. Alternatively, the wet connector 22 can be run down with the receptacle 14 instead of with assembly 53. The ESP 26 and packer 28 are lowered on a wireline and into engagement with receptacle 14.

This written description uses examples to disclose the invention, including the best mode, and also to enable any person skilled in the art to practice the invention, including making and using any devices or systems and performing any incorporated methods. These embodiments are not intended to limit the scope of the invention. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

What is claimed is:

1. An apparatus for pumping fluid from a well, comprising:

a conduit string located within the well;

a tubular receptacle mounted to the conduit string, the receptacle having a side wall with at least one port extending therethrough;

at least one auxiliary tube connected to the port, the auxiliary tube fastened to the outside of the conduit string and extending to the surface;

an electrical wet connector having an outer diameter smaller than an inner diameter of the conduit string, the electrical wet connector adapted to be lowered through the conduit string into seating engagement with the receptacle, the wet connector having at least one conductor on its inside surface in alignment with the port, the wet connector having a wet connector stab-in section;

an electrical submersible pump assembly (ESP) having a motor that drives a pump, the motor having a motor stab the ESP adapted to be lowered through the conduit string such that the motor stab stabs into engagement with the wet connector stab-in section, electrically engaging the motor with the conductor of the wet connector; and an electrical power cable run from an external power source at the surface through the at least one auxiliary tube and into electrical engagement with the conductor on the electrical wet connector, the power cable providing electrical power for the ESP.

2. The apparatus of claim 1, wherein the conduit string, receptacle, and the auxiliary tube are cemented within the well.

3. The apparatus of claim 1, wherein the power cable has a lower end that is retained within the port.

4. The apparatus of claim 1, wherein the receptacle has an inner diameter at least equal to the inner diameter of the conduit string.

5. The apparatus of claim 1, wherein the receptacle and the wet connector have passages that allow production fluid to flow through them during operation.

6. The apparatus of claim 1, wherein the receptacle is attached to and protrudes downward from the conduit string as the conduit string is lowered into the well, and a seal stab extends downward from the receptacle for stabbing into a lower packer installed in the well.

7. The apparatus of claim 1, wherein the at least one auxiliary tube is comprised of one of the following:

a.) continuous coiled tubing; or b.) sections of tubing connected end to end.

8. The apparatus of claim 1, wherein the an annular protuberance, and the power cable has a lower end with an annular recess that snaps into latching engagement with the protuberance when the lower end of the power cable lands in the port.

9. An apparatus for producing fluid from a well, comprising:

a conduit string located within a well;

tubular receptacle secured to the conduit string, the receptacle having a side wall with a port extending therethrough;

at least one auxiliary tube connected at one end to the port, the auxiliary tube fastened to the outside of the conduit string and extending to the surface;

an electrical wet connector lowered through the conduit string and landed in the receptacle, the wet connector having at least one conductor on a side surface, the conductor aligning with the port when the wet connector has landed in the receptacle, the wet connector having a wet connector stab-in section;

an electrical power cable run from an external power source at the surface through the at least one auxiliary tube and into electrical engagement with the conductor on the electrical wet connector;

a through tubing assembly lowered into the conduit string;

an electrical submersible pump and motor comprising part of the through tubing assembly, the through tubing assembly having a through tubing assembly stab that stabs into the wet connector stab-in section in electrical engagement with the conductor of the wet connector for providing electrical power to the motor via the power cable; and an upper packer above an intake of the pump and comprising part of the through tubing assembly for sealing a discharge of the pump from the intake of the pump.

10. The apparatus of claim 9, wherein the conduit string, the receptacle, and the auxiliary tube are cemented within the well.

11. The apparatus of claim 9, further comprising an interior line extending downward from the upper packer to the through, tubing assembly stab for supplying energy to set the packer after the through tubing assembly stab has stabbed into the wet connector stab-in section.

12. The apparatus of claim 9, wherein the port has an annular protuberance, and the power cable has a lower end with an annular recess that snaps into latching engagement with the protuberance when the lower end of the power cable lands in the port.

13. The apparatus of claim 9, wherein the wet connector stab-in section comprises a wet connector receptacle, and the through tubing assembly stab comprises a male stinger.

14. The apparatus of claim 9, further comprising a lower packer set in the well, the through tubing assembly having a tubular seal assembly that lands within a receptacle of the lower packer.

15. The apparatus of claim 1, wherein the power cable has a terminal end that is retained within the port.

16. The apparatus of claim 9, wherein the receptacle and the wet connector have passages that allow production fluid to flow through them during operation.

17. The apparatus of claim 9, wherein one of the at least one a tube carries a hydraulic control line that extends from the surface to the port in the receptacle, and the apparatus further comprises an interior line extending downward from the upper packer to the through tubing assembly stab for supplying hydraulic fluid pressure to set the packer after the through tubing assembly stab has stabbed into the wet connector stab.

18. A method for deploying an electrical submersible pump on a wireline, the method comprising:

providing a receptacle having a side wall with a port extending therethrough;

attaching an auxiliary tubing to the port and the receptacle to a string of conduit and lowering the receptacle into a well while strapping the tubing alongside the string of conduit;

after the string of conduit is installed in the well, lowering a wet mate electrical connector down the string of conduit and landing the wet mate electrical connector in the receptacle;

lowering an electrical cable though the auxiliary tubing and into electrical engagement with the wet mate electrical connector; and providing the electrical submersible pump with an electrical stab and after the wet mate electrical connector has landed in the receptacle, lowering the electrical submersible pump on a wireline through the conduit and into the wet mate electrical connector, and electrically energizing the electrical stab with the wet mate electrical connector.

19. The method of claim 18, further comprising the step of pumping cement through the receptacle and up around the string of conduit before installing the wet mate electrical connector in the receptacle.

20. The method of claim 18, further comprising the steps of:

flowing cement around the receptacle and a lower portion of the auxiliary tubing; and attaching a second auxiliary tubing to the receptacle during the step of attaching said first mentioned auxiliary tubing to the port on the receptacle, and circulating fluid through the second auxiliary tubing and the string of conduit before the step of installing the wet mate electrical connector in the receptacle.

* * * * *

UNITED STATES PATENT AND TRADEMARK OFFICE

CERTIFICATE OF CORRECTION

PATENT NO. : 8,474,520 B2
APPLICATION NO. : 12/835578
DATED : July 2, 2013
INVENTOR(S) : Ignacio Martinez et al.

It is certified that error appears in the above-identified patent and that said Letters Patent is hereby corrected as shown below:

In the Specification:

Column 1, line 47, insert --the-- before "receptacle"
Column 3, line 55, insert --are-- before "run"
Column 5, line 18, delete "stab" and insert --is used--
Column 5, line 63, insert --the-- before "upper end" and insert --the-- before "liner"

In the Claims:

Claim 1, Column 7, line 42, delete "stab" and insert --stab,--
Claim 8, Column 8, line 5, delete "wherein the" and insert --further comprising--
Claim 8, Column 8, line 6, after "and" insert --wherein--
Claim 15, Column 8, line 59, delete "1," and insert --9,--

Signed and Sealed this
First Day of April, 2014

Michelle K. Lee

Michelle K. Lee
*Deputy Director of the United States Patent and Trademark Office*